US005632161A

United States Patent [19]

Shimoya et al.

[11] Patent Number: 5,632,161

[45] Date of Patent: May 27, 1997

[54] LAMINATED-TYPE EVAPORATOR

[75] Inventors: Masahiro Shimoya, Chiryu; Toshiya Nagasawa, Obu; Keiichi Yoshii; Ryouichi Sanada, both of Kariya, all of Japan

[73] Assignee: Nippondenso Co., Ltd., Kariya, Japan

[21] Appl. No.: 494,397

[22] Filed: Jun. 26, 1995

[30] Foreign Application Priority Data

Jun. 27, 1994 [JP] Japan ..... 6-144509

[51] Int. Cl.[6] ..... F25B 39/02

[52] U.S. Cl. ..... 62/515; 62/513; 62/113

[58] Field of Search ..... 62/113, 513, 515

[56] References Cited

U.S. PATENT DOCUMENTS 4,794,765 1/1989 Carella et al. ..... 62/515 X
4,821,531 4/1989 Yamauchi et al. ..... 62/515
5,245,843 9/1993 Shimoya et al. .
5,390,507 2/1995 Shimoya et al. ..... 62/513 X

FOREIGN PATENT DOCUMENTS 3-87071 9/1991 Japan .

*Primary Examiner*—Christopher Kilner
*Attorney, Agent, or Firm*—Cushman, Darby & Cushman, IP Group of Pillsbury Madison & Sutro, LLP

[57] ABSTRACT

A laminate-type evaporator is disclosed which is formed of a main heat exchanger, an auxiliary heat exchanger, and a connecting member integrally brazed, such that brazing performance between the auxiliary heat exchanger and the connecting member is enhanced and moisture does not remain between the auxiliary heat exchanger and the connecting member, while setting brazing temperature to a temperature which does not melt the main heat exchanger and also while shortening brazing time. Convexities are formed on a block joint, and a width of a brazed portion connecting these convexities and an end plate is made to be 5 mm or less. Additionally, a dimension of a clearance between the end plate and block joint is made to be 0.5 mm or more.

14 Claims, 13 Drawing Sheets

LAMINATED-TYPE EVAPORATOR

CROSS REFERENCE TO RELATED APPLICATIONS

This application is based upon and claims priority from Japanese Patent Application No. Hei-6-144509 filed Jun. 27, 1994.

BACKGROUND OF THE INVENTION

1. Field of the Invention

The present invention relates to a laminated-type evaporator forming refrigerant passages by a laminated structure of metal thin plates, and more particularly, to a laminated-type evaporator having an auxiliary heat exchanger to perform heat exchange between mutual internal refrigerants flowing within refrigerant passages.

2. Description of the Related Art

In Japanese Patent Application Laid-Open No. Hei 5-196321 (corresponding to U.S. Pat. No. 5,245,843), the same applicant has proposed a laminated-type evaporator having an auxiliary evaporator to perform heat exchange between mutual internal refrigerants flowing within refrigerant passages. The device disclosed in the foregoing Japanese Patent Laid-Open provides, in addition to a main heat exchanger performing ordinary heat exchange between refrigerant and air, an auxiliary heat exchanger (refrigerant-refrigerant heat exchanger) facilitating heat exchange between refrigerant of an inlet-side of the evaporator and refrigerant of an outlet-side of the evaporator. This device increases the moisture of refrigerant flowing into an inlet tank of the main heat exchanger.

The purpose of this auxiliary heat exchanger is to increase the moisture of the refrigerant flowing into the inlet tank of the main heat exchanger and to put the refrigerant in the inlet tank in a state of approximately liquid single phase. Therefore, when refrigerant is distributed from the inlet tank to a plurality of tubes, it is distributed uniformly to the respective tubes. Moreover, since the inner surfaces of the respective tubes are covered by the liquid refrigerant, the thermal transmission rate at the tube inner surfaces is improved, which improves the cooling performance of the evaporator.

According to experimental investigation by the inventors, however, in the device disclosed in the foregoing Japanese Application Laid-Open, it was discovered that difficulties such as will be described hereinafter occur when a block joint, provided in the evaporator for connecting the refrigerant piping from the pressure-reducing unit side and refrigerant piping to the compressor side to the foregoing auxiliary heat exchanger, is fixed by brazing.

Refrigerant passages in the main heat exchanger of the foregoing evaporator are formed by aligning two thin metal plates of uneven configuration, and the main heat exchanger is structured by laminating the refrigerant passages in a multiplicity of sets. Fins are provided between the foregoing respective sets to enlarge the thermal-transmission surface area of the air side.

Additionally, by laminating several thin metal plates, the auxiliary heat exchanger forms in alternation on the front and rear of the thin metal plates an inlet-side refrigerant passage to introduce refrigerant from the pressure-reducing unit side of the cooling cycle to the main heat exchanger and an outlet-side refrigerant passage to introduce refrigerant from the main heat exchanger to the compressor side. The inlet-side refrigerant passage and the outlet-side refrigerant passage are structured so as to exchange heat between refrigerant flowing through the inlet-side refrigerant passage and refrigerant flowing through the outlet-side refrigerant passage.

The above-described main heat exchanger, auxiliary heat exchanger, and block joint are put into a furnace, heated to a predetermined temperature, and brazed integrally. Because the auxiliary heat exchanger is structured of several thin metal plates laminated alternatingly as described above, density is high and thermal transmission is poor in comparison with the main heat exchanger. That is to say, it is difficult for heat to be transmitted to the interior of the auxiliary heat exchanger. Consequently, in brazing at the above-mentioned predetermined temperature, air bubbles due to faulty brazing occur at the brazing surface between the auxiliary heat exchanger and the block joint.

When air bubbles occur in this way, air exists in the bubbles. Because the clearance between the auxiliary heat exchanger and the block joint is extremely small, moisture contained in the air remains within the air bubbles without escaping. When this moisture is chilled by the evaporator and forms frost, the resulting volume expansion causes large pressure to be applied to an end plate of the auxiliary heat exchanger, and the end plate may be destroyed thereby.

In this regard, the problem of faulty brazing is solved when the above-mentioned brazing temperature is raised further, but if the brazing temperature is raised excessively, the main heat exchanger (and in particular the fins), which has low density and high thermal transfer in comparison with the auxiliary heat exchanger, begins to melt.

Furthermore, the above-described several problems are solved if the above-mentioned brazing temperature is suppressed to the foregoing predetermined temperature and brazing time is lengthened, but this increases the fabrication steps and cost.

SUMMARY OF THE INVENTION

In light of the foregoing difficulties, it is an object of the present invention to provide a laminated-type evaporator formed of the foregoing main heat exchanger, auxiliary heat exchanger, and connecting member integrally brazed, such that brazing performance between the auxiliary heat exchanger and the connecting member is enhanced and moisture does not remain between the auxiliary heat exchanger and the connecting member while setting the brazing temperature to a temperature which does not melt the main heat exchanger and while also shortening brazing time.

To achieve the foregoing object, one preferred mode the present invention adopts a laminated-type evaporator disposed on a downstream side of a pressure reducing means for reducing pressure of a refrigeration cycle and on an intake side of a compressor for evaporating pressure-reduced refrigerant by the pressure reducing means. The evaporator includes:

a main heat exchanger having a refrigerant passage therein for performing heat exchange between refrigerant flowing within the refrigerant passage and cooled fluid flowing outside the refrigerant passage;

an auxiliary heat exchanger having an inlet-side refrigerant passage introducing refrigerant from the pressure reducing means toward an inlet of the main heat exchanger refrigerant passage and an outlet-side refrigerant passage introducing refrigerant from an outlet of the main heat exchanger toward the compressor, the auxiliary heat exchanger performing heat exchange between refrigerant flowing through the inlet-side refrigerant passage and refrigerant flowing through the outlet-side refrigerant passage; and a connecting member having a first communication hole connecting with a downstream-side pipe of the pressure reducing means and a second communication hole connecting with intake-side pipe of the compressor, the connecting member being fixed to the auxiliary heat exchanger for communicating the first communication hole and the inlet-side refrigerant passage and communicating the second communication hole and the outlet-side refrigerant passage, wherein the refrigerant passage of the main heat exchanger is formed by an internal space formed by a pair of laminated thin metal plates, the main heat exchanger is provided with a plurality of the pair of thin metal plates, and fin means for enlarging a thermal-transmission surface area of the cooled fluid is provided between the respective pair of thin metal plates, the inlet-side refrigerant passage and the outlet-side refrigerant passage of the auxiliary heat exchanger are formed alternately on a front and rear of the respective thin metal plates by lamination of a plurality of alternately adjacent thin metal plates, the connecting member has convexities contacting the auxiliary heat exchanger and a clearance of not less than a predetermined dimension is formed between the connecting member and the auxiliary heat exchanger, and the connecting member and the auxiliary heat exchanger make contact with a width of not more than a predetermined dimension.

Another preferred mode of the present invention includes convexities on the auxiliary heat exchanger.

Additionally, in a further preferred mode of the present invention, clearance formed between the auxiliary heat exchanger and the connecting member is preferably set to be 0.5 mm or more.

Additionally, in still a further preferred mode of the present invention, the width of a portion of contact between the auxiliary heat exchanger and the connecting member is preferably set to be 5 mm or less.

In the present invention, the width of a portion of contact of the connecting member and auxiliary heat exchanger is not more than a predetermined dimension. Consequently, even when the entirety of the evaporator is brazed at a temperature at which the main heat exchanger (and in particular the fin structure) does not melt and the portion where the foregoing connecting member and auxiliary heat exchanger make contact is thereby fixed by brazing, this portion can be brazed without causing air bubbles to be generated.

Additionally, regarding the portion where the connecting member and auxiliary heat exchanger do not make contact, because a clearance of not less than a predetermined dimension is formed between the connecting member and auxiliary heat exchanger by contact of the auxiliary heat exchanger and convexities formed on the connecting member or by contact of the connecting member and convexities formed on the auxiliary heat exchanger, moisture contained in the air escapes to the outside with the air even if it enters this clearance.

In the present invention, where a threaded hole is formed in the connecting member, an advantage which will be described hereinafter, is manifested by locating this threaded hole so as to oppose the foregoing clearance.

Briefly, as shown in FIG. 13, if an end portion 300 of a threaded hole 30 formed in a connecting member 13 either makes contact with an end plate 12 of the main heat exchanger, or if a gap between the end portion 300 and the end plate 12 is exceedingly small, brazing material (the filled-in black portion of the drawing) penetrates within this threaded hole 30 due to capillary action, destroying the thread ridges of the threaded hole 30.

Accordingly, in the present invention, penetration of brazing material into the thread hole due to capillary action is eliminated by causing the end portion 300 of the threaded hole 30 to oppose the above-described clearance.

DETAILED DESCRIPTION OF THE PREFERRED EMBODIMENTS

Figure 1:
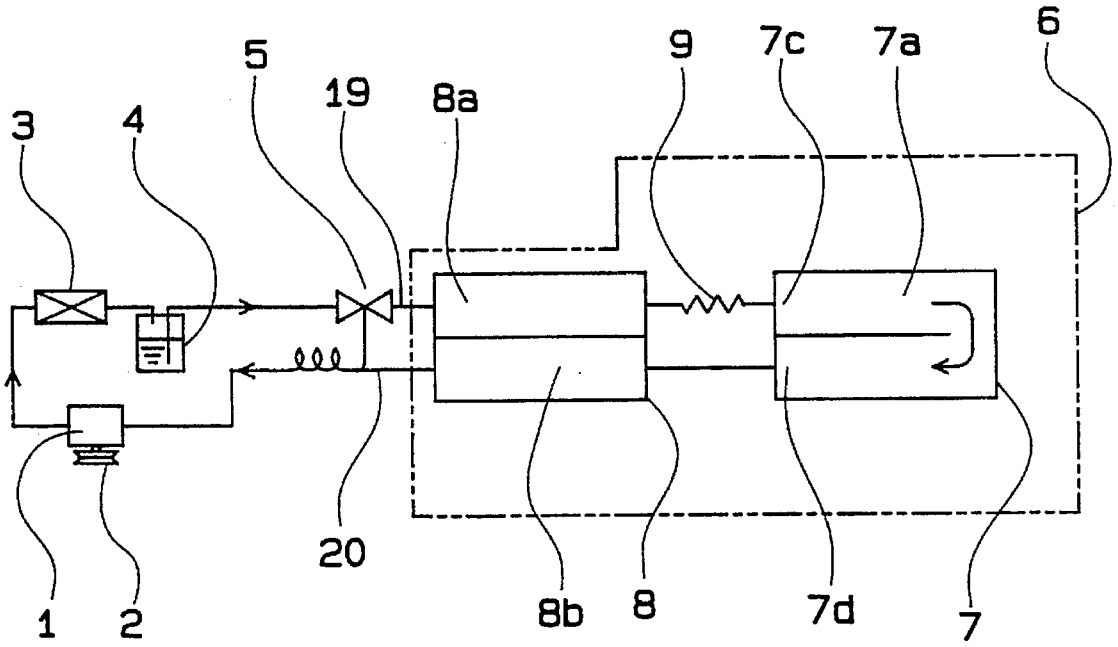
FIG. 1 is a schematic drawing of a refrigeration cycle including an evaporator according to a first embodiment of the present invention.

A first embodiment according to the present invention will be described hereinafter with reference to the drawings. FIG. 1 indicates a refrigeration cycle of an air-conditioning apparatus for automotive use employing an evaporator according to the present invention; a compressor 1 is driven by an automobile engine (not illustrated) via an electromagnetic clutch 2. A condenser 3 cools and condenses high-temperature, high-pressure gas refrigerant discharged from the compressor 1 by exchanging heat with blown air from a cooling fan (not illustrated).

A receiver 4 collects liquid refrigerant condensed by the condenser 3 and introduces only liquid refrigerant to the downstream side of the cycle. A temperature-actuated type expansion valve 5, which serves as a pressure reducing means, reduces the pressure of the refrigerant. A laminated-type refrigerant evaporator 6 has a main heat exchanger 7, to cause heat exchange between refrigerant flowing within a refrigerant passage 7*a* and blown air for air-conditioning use (cooled fluid) flowing outside the refrigerant passage 7*a*, and an auxiliary heat exchanger 8, to cause heat exchange between refrigerant flowing into an inlet side of the refrigerant passage 7*a* and refrigerant flowing out from an outlet side of the refrigerant passage 7*a*.

Herein, in the auxiliary heat exchanger 8, an inlet-side refrigerant passage 8*a* is disposed upstream of the inlet side of the above-described refrigerant passage 7*a*. An outlet-side refrigerant passage 8*b* is disposed downstream of the outlet side of the refrigerant passage 7*a*. Thus, the auxiliary heat exchanger 8 forms a refrigerant-refrigerant heat exchanger. Meanwhile, the main heat exchanger 7 forms a refrigerant-air heat exchanger in which the refrigerant absorbs heats from blown air and evaporates.

A refrigerant passage 9 is a passage having minute cross-sectional surface area formed in a meandering configuration between the inlet-side refrigerant passage 8*a* of the auxiliary heat exchanger 8 and an inlet portion of the refrigerant passage 7*a* of the main heat exchanger 7, and functions as a pressure reducing means which is generally termed as a capillary tube. However, because the degree of pressure reduction by this refrigerant passage 9 is set to be smaller than the degree of pressure reduction of the expansion valve 5, this refrigerant passage 9 operates as an auxiliary pressure reducing means. Thus by setting a refrigerant temperature difference between the refrigerant temperature of the inlet-side refrigerant passage 8*a* and the refrigerant temperature of the outlet-side refrigerant passage 8*b* of the auxiliary heat exchanger 8, heat exchange between the two refrigerant passages 8*a* and 8*b* is performed favorably.

The above-described main and auxiliary heat exchangers 7 and 8 and the minute refrigerant passage 9 are formed by a laminated structure of thin metal plates. Structure thereof is basically identical with the aforementioned Japanese Patent Application Laid-Open No. Hei 5-196321. The laminated structure will be describe hereinafter with reference to FIGS. 2 and 3. Thin metal plates 7*b* are formed into a predetermined configuration by making double-sided cladding material clad with brazing material (A 4000 series composition) on two sides of an aluminum core material. A plurality of sets, each set being laminated from a pair of the thin metal plates 7*b*, are laminated and jointed by brazing. A plurality of refrigerant passages 7*a* are formed in parallel in internal spaces of each set of thin metal plates.

The plurality of refrigerant passages 7*a* have a U-shaped configuration whereby each makes a U-turn at an upper end. The inlet portions and outlet portions of these respective refrigerant passages 7*a* of U-shaped configuration are communicated respectively in a core-depth direction at opening portions of an inlet-side tank 7*c* and outlet-side tank 7*d* formed at lower portions of the respective passages. Additionally, in the main heat exchanger 7, corrugated fins (fin means) 11 are jointed at alternating intervals on the outer surfaces of adjacent refrigerant passages 7*a* to as to enlarge the thermal-transmission surface area of the air side.

Similarly, in the auxiliary heat exchanger 8 as well, a plurality of adjacent thin metal plates 8*c*, formed into a predetermined configuration by making double-sided cladding material clad with brazing material on two sides of an aluminum core material, are laminated and joined by brazing, thereby the above-described inlet-side refrigerant passage 8*a* and outlet-side refrigerant passage 8*b* are formed on the front and rear side, respectively, of each thin metal plate 8*c* of the multiple-plate laminated structure. Accordingly, inlet-side refrigerant passage 8*a* and outlet-side refrigerant passage 8*b* are each formed between alternating pairs of the laminated plurality of thin metal plates 8*c*.

In this way, the present embodiment assumes a structure whereby the density of the auxiliary heat exchanger 8 is larger in comparison with the main heat exchanger 7.

Herein, a block joint 13 is joined as a connecting member to the end plate 12 of the auxiliary heat exchanger 8. An inlet tube 13*a*, as a first communication hole into which vapor-liquid two-phase refrigerant pressure-reduced by the expansion valve 5, and an outlet tube 13*b*, as a second communication hole from which flows gas refrigerant taken into the compressor 1 side from the evaporator 6, are formed in this block joint 13. Threaded holes 30*a* and 30*b* for bolt-tightening a piping block joint 50 which will be described later (see FIGS. 4 through 6) and the block joint 13 are also formed in this block joint 13.

Accordingly, refrigerant from this inlet tube 13*a* flows into an inlet-side tank 8*d* of the inlet-side refrigerant passage 8*a* formed on an upper portion of the thin metal plates 8*c*; this inlet-side tank 8*d* is extending in a core-depth direction at an opening portion thereof. Meanwhile, an outlet-side tank 8*e* of the inlet-side refrigerant passage 8*a* is formed on a lower portion of the thin metal plates 8*c*; this outlet-side tank 8*e* is also extending in a core-depth direction at an opening portion thereof. Accordingly, the inlet-side refrigerant passage 8*a* is formed in a meandering configuration from the inlet-side tank 8*d* of the upper porion to the outlet-side tank 8*e* of the lower portion.

Additionally, the above-described minute refrigerant passage 9 is also formed between the thin metal plates 7*b* of the main heat exchanger 7 which are closest to the auxiliary heat exchanger 8 and an intermediate plate 14 of large plate thickness interposed between the main and auxiliary heat exchangers 7 and 8.

After refrigerant flowing out from the outlet-side tank 8*e* of the inlet-side refrigerant passage 8*a* has subsequently passed through the minute refrigerant passage 9, it flows into the inlet-side tank 7*c* of the main heat exchanger 7, flows therefrom in a U-turn configuration through the respective refrigerant passages 7*a* of the main heat exchanger 7, and thereafter is collected in the outlet-side tank 7*d*.

Refrigerant which has collected in this outlet-side tank 7*d* flows into an inlet-side tank 8*f* of the outlet-side refrigerant passage 8*b* formed on a lower portion of the thin metal plates 8*c* of the auxiliary heat exchanger 8; this inlet-side tank 8*f* extends in a core-depth direction at an opening portion thereof. An outlet-side tank 8*g* of the outlet-side refrigerant passage 8*b* is formed on a higher portion of the thin metal plates 8*c*; this outlet-side tank 8*g* also extends in a core-depth direction at an opening portion thereof. Accordingly, the outlet-side refrigerant passage 8*b* is formed in a meandering configuration from the inlet-side tank 8*f* of the lower portion to the outlet-side tank 8*g* of the upper portion.

The inlet-side refrigerant passage 8*a* and outlet-side refrigerant passage 8*b* are formed alternatingly on both the front and rear sides of the multiple-plate laminated thin metal plates 8*c* in the auxiliary heat exchanger 8. Refrigerant flows out from the outlet-side tank 8*g* of the outlet-side refrigerant passage 8*b* to the outlet tube 13*b* of the piping connecting member 13. Numeral 15 is an end plate of the main heat exchanger 7.

A method of fabrication of the refrigerant evaporator 6 will be descried next.

According to the present embodiment, the evaporator 6 is to be fabricated by integral brazing of aluminum, and so all other parts, except for the block joint 13 which is a part of large plate thickness requiring cold forgoing, cutting, and the like, are formed from aluminum double-sided clad material clad on both sides with brazing material.

A method of fabrication will be described hereinafter in production-step sequence.

(1) Individual assembly steps for fabricating the main heat exchanger 7 and auxiliary heat exchanger 8.

For the main heat exchanger 7, firstly two thin metal plates 7*b* and 7*b* sandwiching the corrugated fins 11 are made integral by crimping and flanging a burring-configuration portion (not illustrated) of the inlet tank 7*c* and outlet tank 7*d*, making these three members 11, 7*b* and 7*b* a single unit. Thereafter, the end plate 15, the unitized metal thin plates 7*b* and 7*b* and corrugated fins 11, and the metal thin plate 7*b* forming the minute refrigerant passage 9 are laminated in the configuration shown in FIGS. 2 and 3, completing assembly of the main heat exchanger 7.

Figure 2:
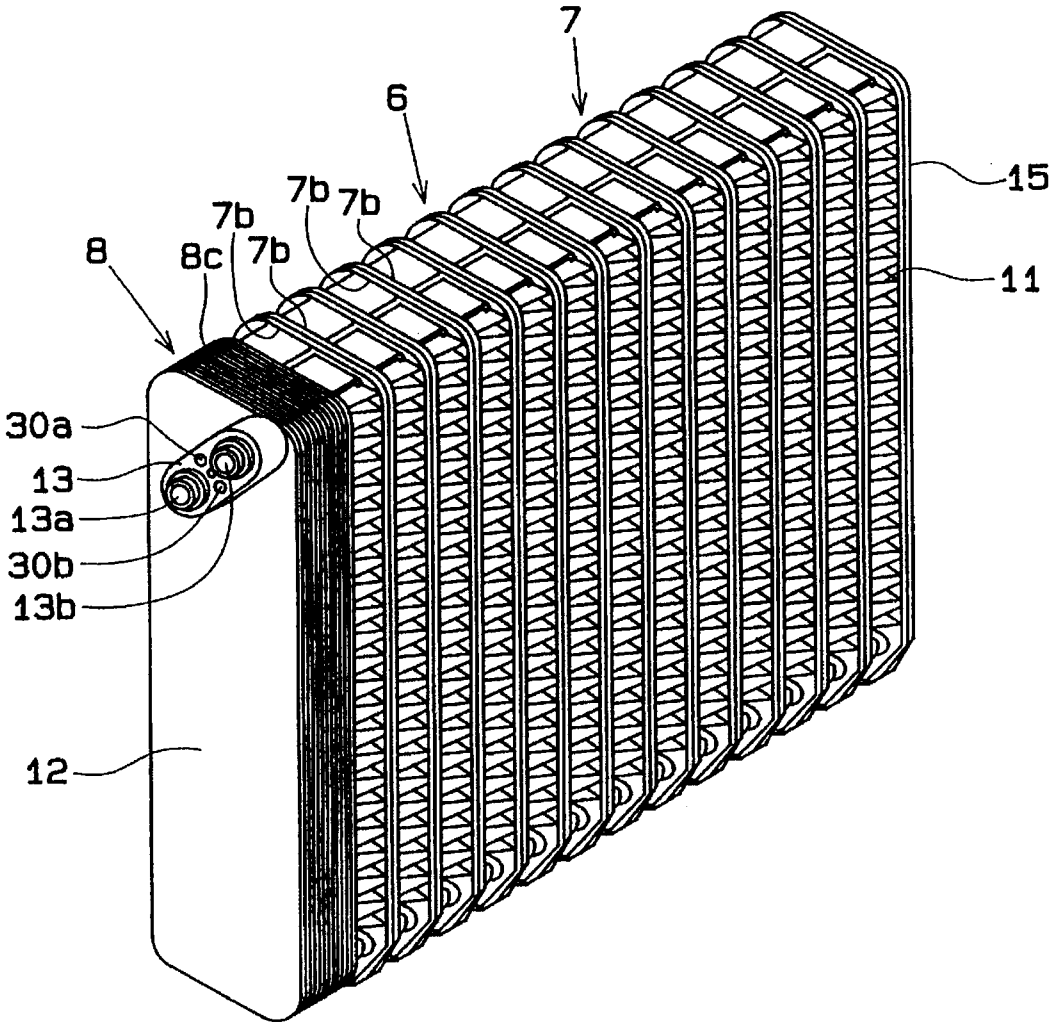
FIG. 2 is a perspective view of the foregoing evaporator.
Figure 3:
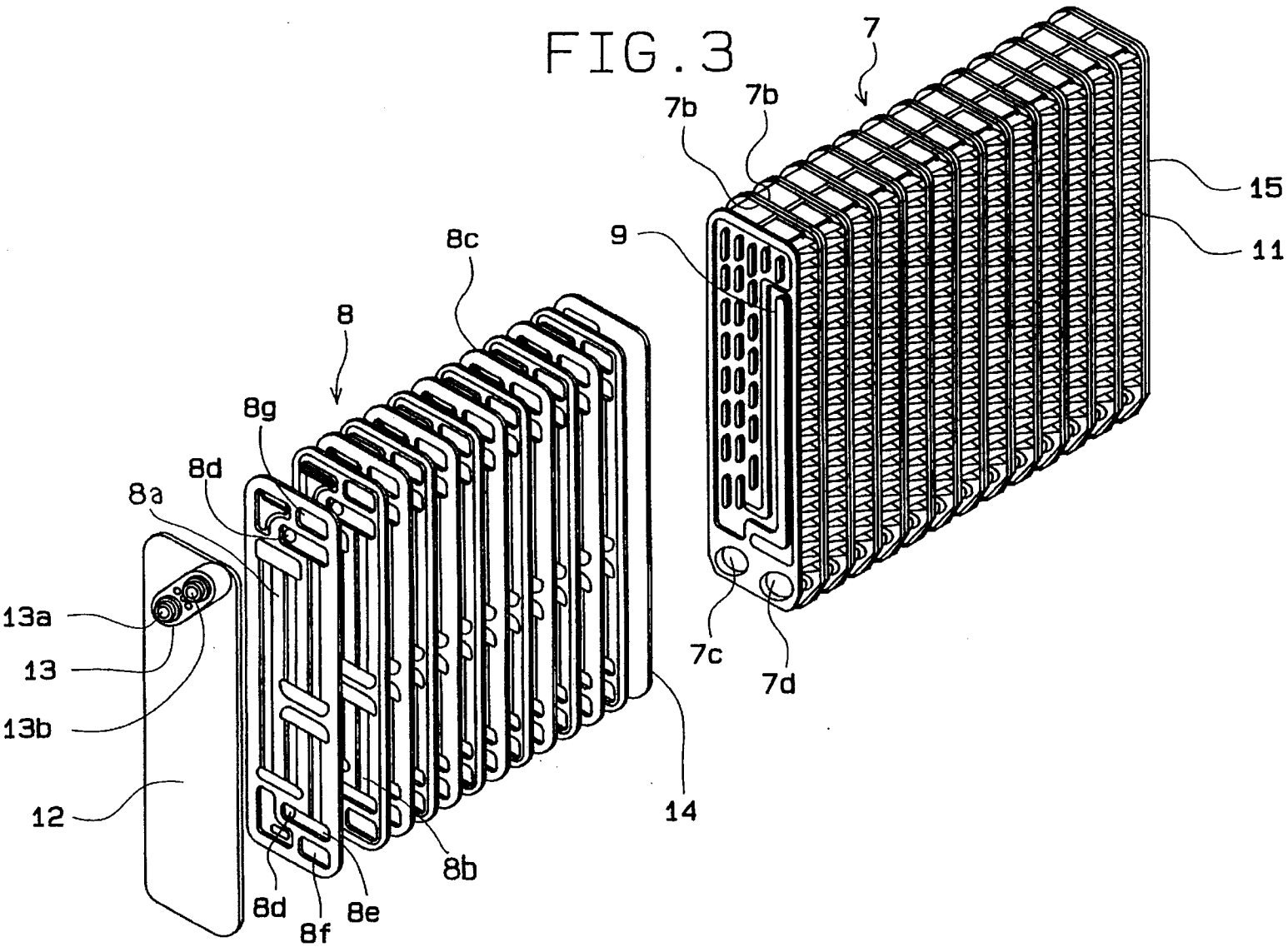
FIG. 3 is an exploded perspective view of the evaporator of FIG. 2.

For the auxiliary heat exchanger 8, the intermediate plate 14 priority machined with a refrigerant-inlet hole (not illustrated), the thin metal plate 8*c*, and the end plate 12 are laminated in the configuration shown in FIGS. 2 and 3. Along with this, the block joint 13 is attached to the end plate 12, completing assembly of the auxiliary heat exchanger 8.

(2) Assembly steps for fabricating the entirety of the evaporator 6

The main heat exchanger 7 and auxiliary heat exchange 8, respectively assembled individually in the above-described manner, are assembled with the main heat exchanger 7 below and the auxiliary heat exchanger 8 positioned thereabove. The laminated and assembled body of these two members 7 and 8 is supported vertically by an assembly fixture (not illustrated), maintaining a laminated state of the entirety of the evaporator 6.

(3) Integral brazing step of the entirety of the evaporator 6

While maintaining the laminated state of the above-described two heat exchangers 7 and 8 by the vertical assembly fixture, the assembled body is transferred into a vacuum furnace, heated to at least the brazing-material melting point of the aluminum-clad material (for example 560° C. to 590° C.), and joined integrally by brazing the jointing portions of the respective portions of the assembly so as to integrally form the entirety of the evaporator 6. The foregoing furnace-interior temperature must be set at or below 650° C., which is the melting point of aluminum.

Fabrication of a framework structure of the evaporator 6 can be completed by the foregoing, and thereafter fabrication of the evaporator 6 can be completed by finishing with a surface treatment and the like.

Figure 4:
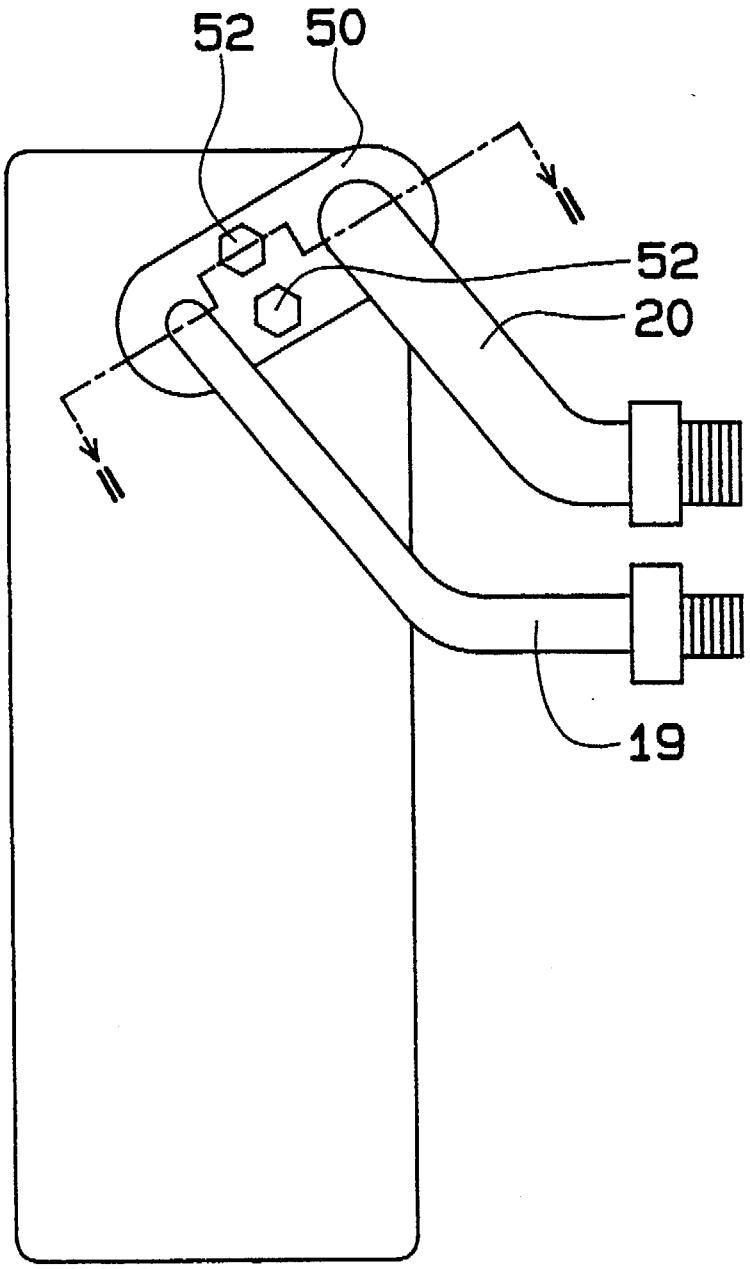
FIG. 4 is a side view of the evaporator in a state of engagement with a piping block joint.

An engaged state of the above-described piping block joint 50 and block joint 13 will be described next with reference to FIGS. 4 through 6. Herein, FIG. 4 is a side view of the evaporator 6 with the piping block joint 50 engaged with the block joint 13, FIG. 5 is a front view of the evaporator 6 which indicates the engagement method of the piping block joint 50 to the block joint 13, and FIG. 6 is a sectional view taken along line VI—VI of FIG. 4.

Figure 5:
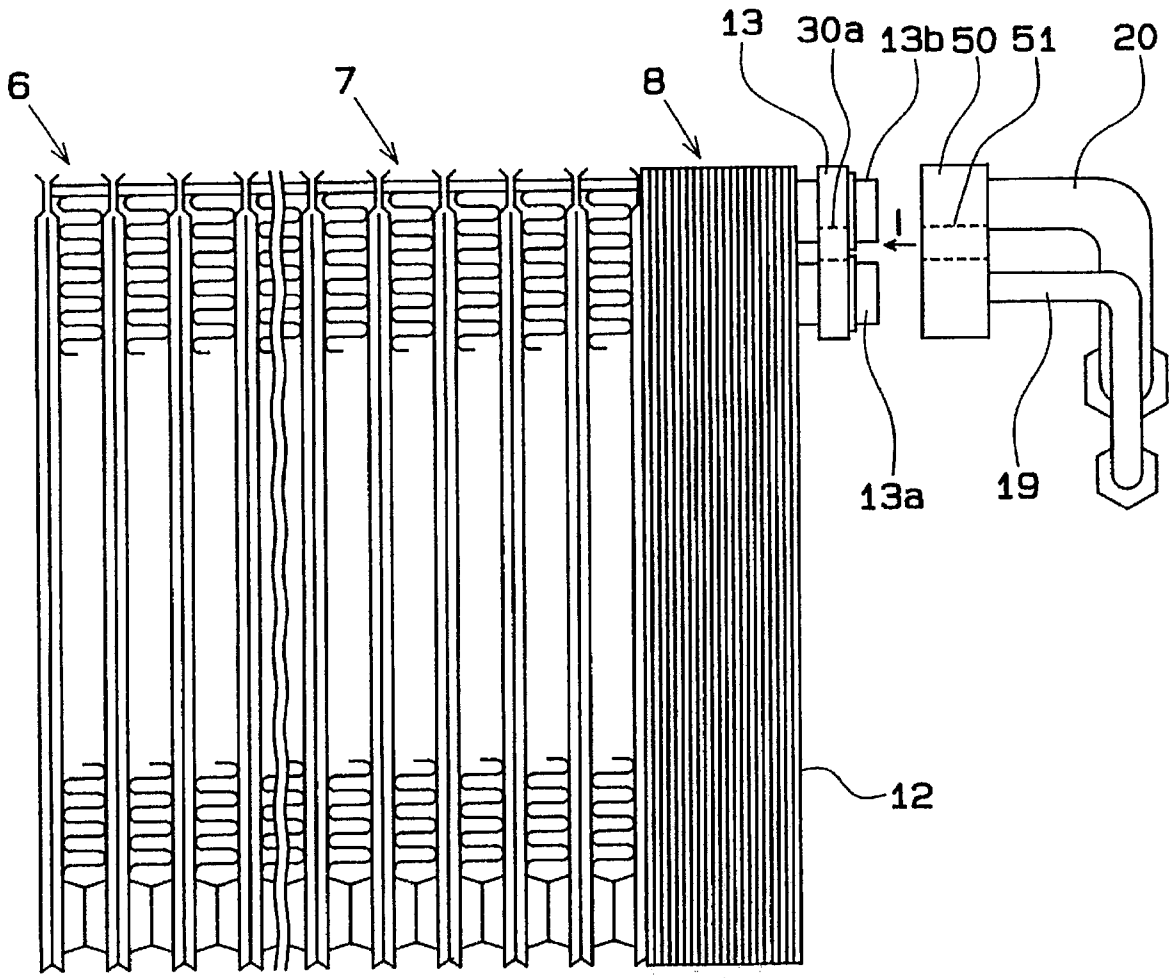
FIG. 5 is a front view of the evaporator.
Figure 6:
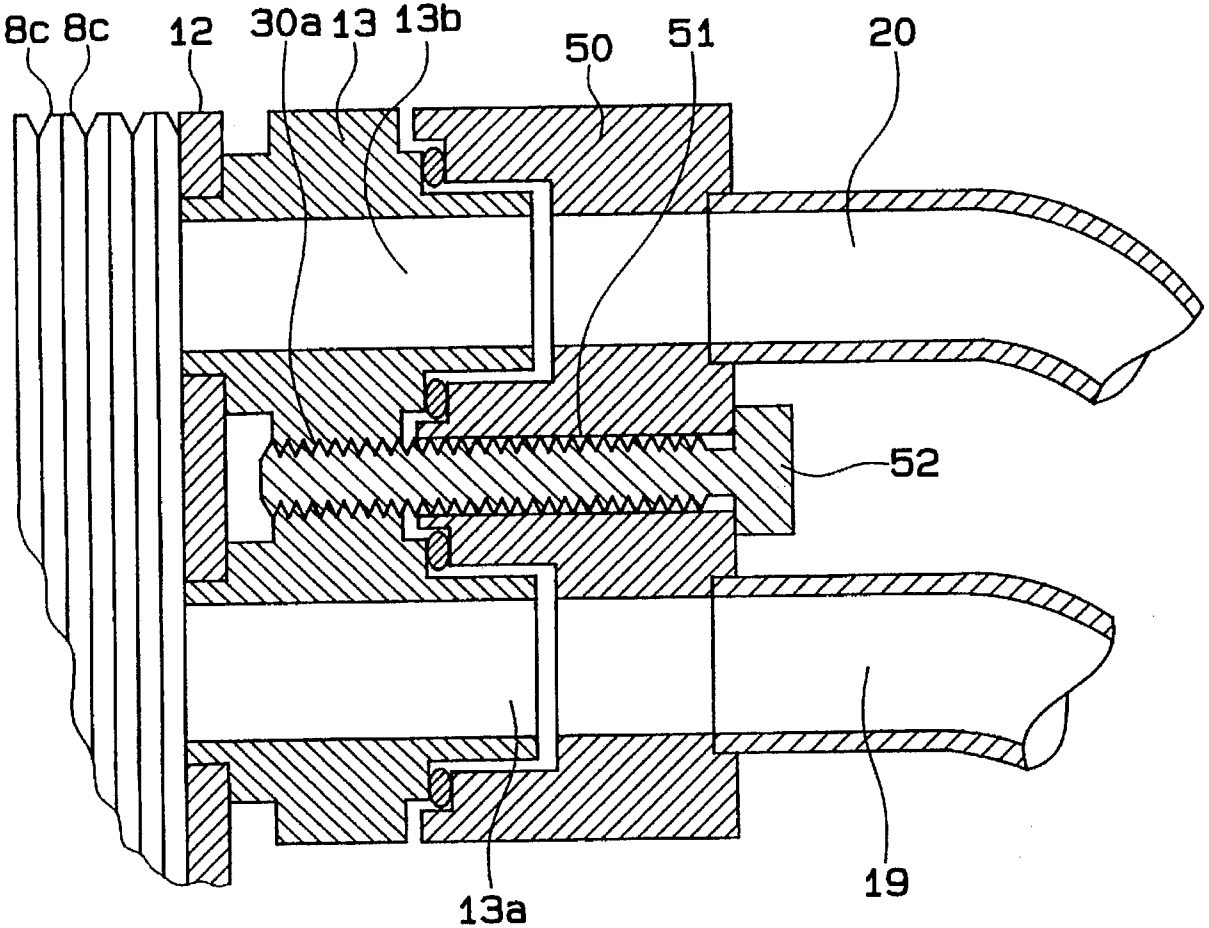
FIG. 6 is a sectional view taken along line VI—VI of FIG. 4.

Firstly, as shown in FIG. 5, the piping block joint 50 is joined to the block joint 13 in the direction of arrow A of FIG. 5 so that two bolt through-holes 51 (only one through-hole 51 is illustrated in FIG. 5) in which thread ridges have not been formed oppose the two threaded holes 30*a* and 30*b*. Accordingly, by inserting bolts 52 into the through-holes 51 from the right side of FIG. 5 and moreover screwing the bolts 52 into the threaded holes 30*a* and 30*b*, the piping block joint 50 and the block joint 13 are engaged as shown in FIG. 6.

By engaging the piping block joint 50 to the block joint 13 in this way, the inlet tube 13*a* and downstream-side piping 19 of the expansion valve 5 are joined, and the outlet tube 13*b* and inlet-side piping 20 of the compressor 1 are joined.

Figure 7:
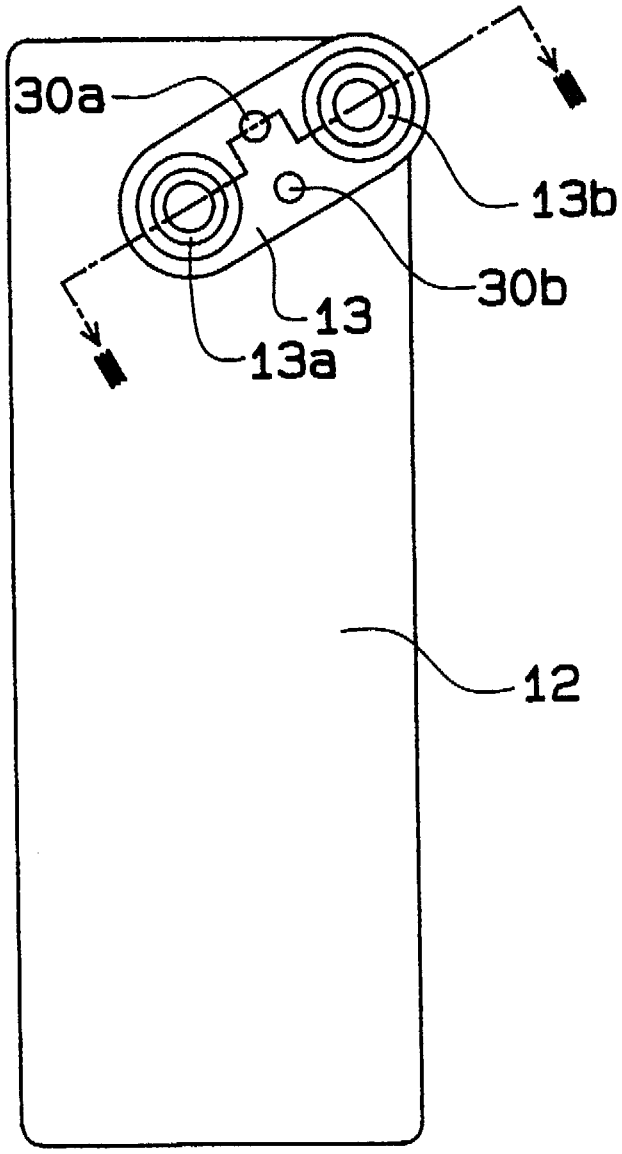
FIG. 7 is a side view of the evaporator with a piping block joint not engaged.

Connection of the end plate 12 of the auxiliary heat exchanger 8 and the block joint 13 will be described next with reference to FIGS. 7 through 10. Herein, FIG. 7 is a side view of the evaporator 6 with the piping block joint 50 not connected with the block joint 13, FIG. 8 is a front view of the evaporator 6 with the piping block joint 50 not connected with the block joint 13, FIG. 9 is a sectional view taken along line IX—IX of FIG. 7, and FIG. 10 is a perspective view indicating a brazed portion of the block joint 13 and the end plate 12.

Figure 8:
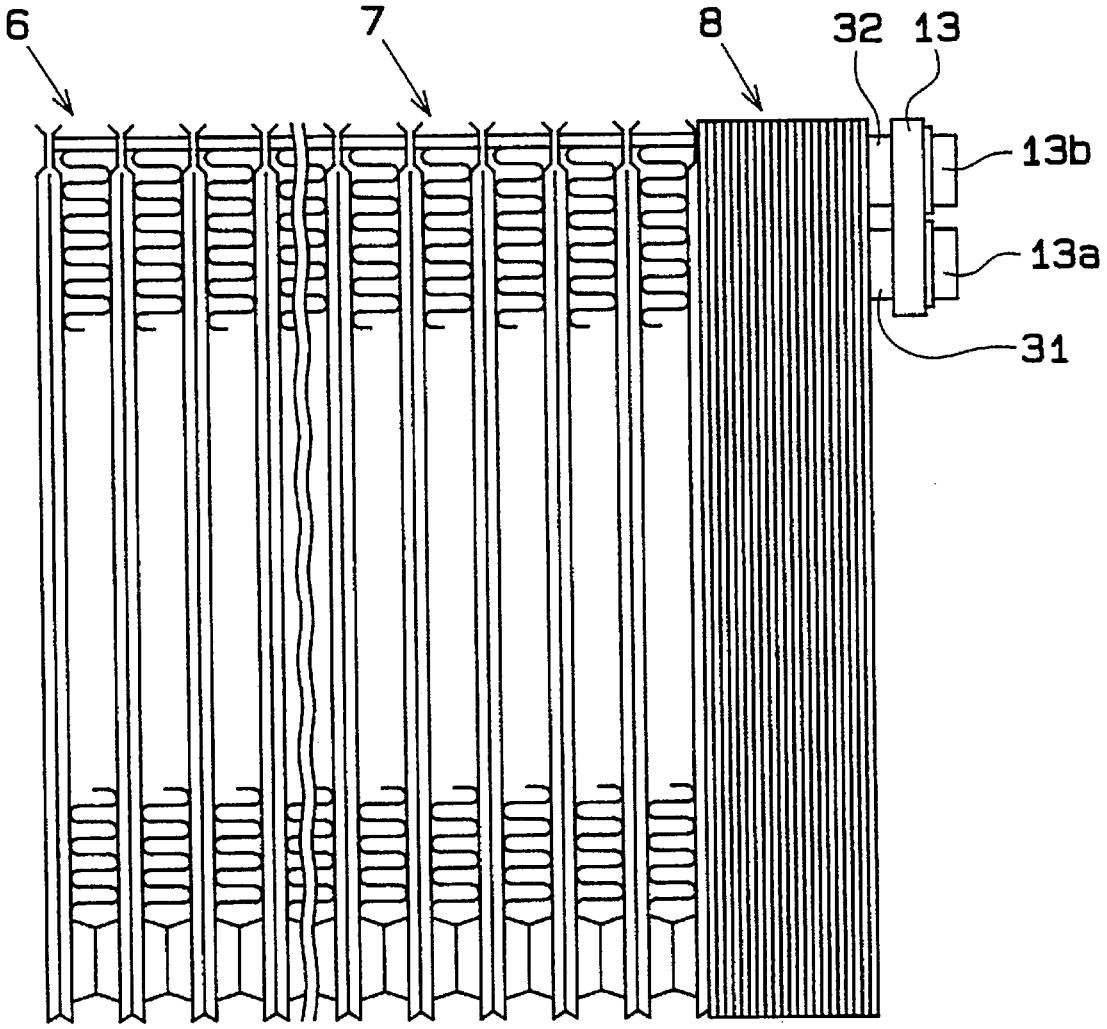
FIG. 8 is a front view of the evaporator.
Figure 9:
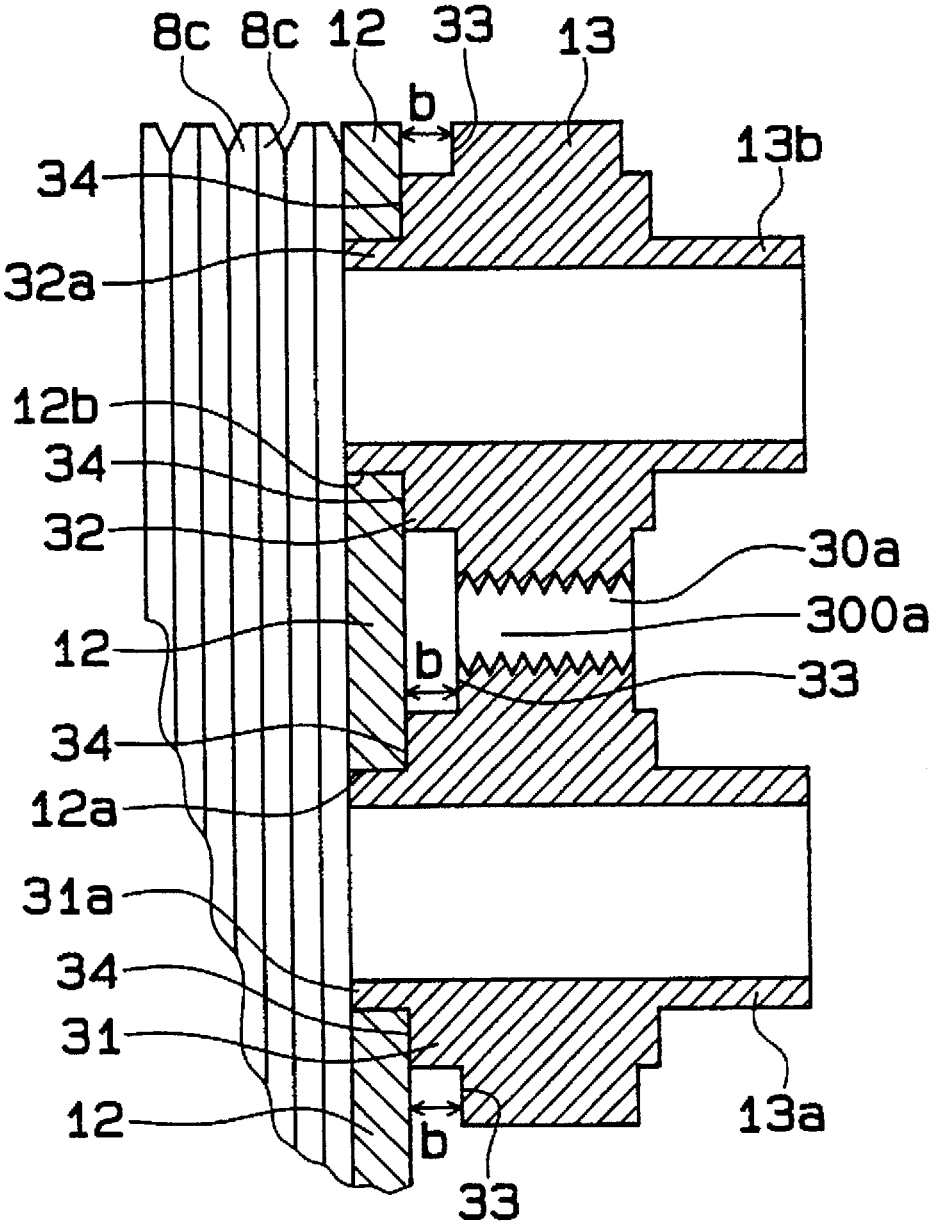
FIG. 9 is a sectional view taken along line IX—IX of FIG. 7.

As shown in FIGS. 8 and 9, convexities 31 and 32 of hollow-cylinder configuration are formed on a surface of the block joint 13 which opposes the end plate 12. Furthermore, projections 31*a* and 32*a* of hollow-cylinder configuration are formed on the convexities 31 and 32. Projections 31*a* and 32*a* are fitted into holes 12*a* and 12*b*, respectively, formed in the end plate 12 of the auxiliary heat exchanger 8. Additionally, a concavity 33 is formed on a surface opposing the end plate 12 by the formation of the convexities 31 and 32.

Figure 10:
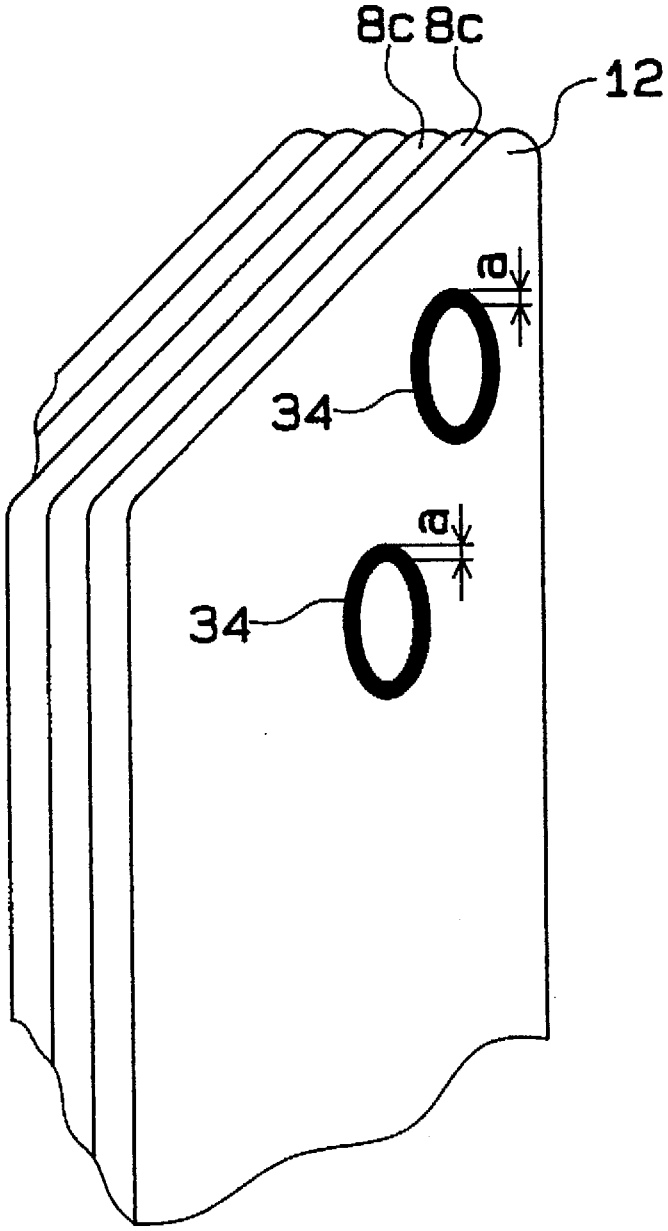
FIG. 10 is a perspective view indicating a brazed portion of the block joint and end plate.

With this configuration, the surface where the convexities 31 and 32 and the surface of the block joint 13 side of the end plate 12 make contact assumes an annular configuration as indicated by symbol 34 of FIG. 10. The convexity 32 is formed so that the width "a" of the contact portion 34 (indicated by "a" in FIG. 10) is designed to be 5 mm or less, a width "a" of 3 mm being preferred.

Accordingly, when brazing the evaporator 6, the brazing material clad on the surface of the end plate 12 collects in the contact portion 34 by capillary action, and this contact portion 34 becomes the brazed portion. According to the present embodiment, the width "a" of the brazed portion is 5 mm or less, which, because of the small size of contact portion 34, prevents the occurrence of air bubbles in the brazed portion at the time of brazing.

Additionally, a clearance is formed between the block joint 13 and the end plate 12 at the portion where the block joint 13 and end plate 12 do not make contact due to the above-described convexities 31 and 32. The convexities 31 and 32 (i.e., the concavity 33) is formed so that this clearance (indicated by "b" in FIG. 9) is 0.5 mm or more, "b" equal to 1 mm being preferred.

Because a clearance of 0.5 mm or more is formed in this way at the portion where the block joint 13 and end plate 12 do not make contact, moisture, which penetrates into this clearance together with air, escapes easily together with the air. That is to say, moisture in air does not remain between the block joint 13 and the end plate 12.

Additionally, according to the present embodiment the above-described threaded holes 30*a* and 30*b* are formed so that an end portion 300*a* of the threaded holes (an end portion for the threaded hole 30*b* is not illustrated) opposes the foregoing clearance. Brazing material of the above-described brazed portion 34 does not penetrate into the threaded holes 30*a* and 30*b* by capillary action because of the clearance. Therefore, the threads of the threaded holes 30*a* and 30*b* are not damaged.

According to the present embodiment, because of the small size of the clearance between the end portion 300*a* of the threaded holes and the end plate 12, preferably 1 mm, it is impossible to screw a bolt from the side of this clearance into the threaded holes 30*a* and 30*b*. That is to say, bolts 52 can only be screwed in from the side opposite to this clearance.

Consequently, in attaching the block joint 13 to the piping block joint 50 with the bolts 52, the bolts 52 must be screwed from the piping block joint 50 side. Consequently, if threads are not formed in the holes 30*a* and 30*b* of the block joint 13, the block joint 13 and the piping block joint 50 cannot be connected by the bolts 52.

Accordingly, it is important to avoid damage to the threads of holes 30*a* and 30*b*, and thus the advantage of the clearance provided at end 300*a* of holes 30*a* and 30*b* can be appreciated.

Additionally, according to the present embodiment the laminated structure of the main heat exchanger 7, auxiliary heat exchanger 8, and block joint 13 is put into a furnace heated to a temperature not less than the melting point of the brazing material of the aluminum-clad material (for example 560° C. to 590° C.) and is integrally brazed. Because the structure is such that the density of the auxiliary heat exchanger 8 is large in comparison with that of the main heat exchanger 7, as described above, the thermal transmission of the auxiliary heat exchanger 8 is poor in comparison with the main heat exchanger 7. Consequently, in brazing at the foregoing temperature, brazing performance between the auxiliary heat exchanger 8 and the block joint 13 is poor in comparison with brazing performance between the thin metal plates 7*b* of the main heat exchanger 7 and the fins 11.

However, according to the present embodiment, the width "a" of the brazed portion 34 of the end plate 12 of the auxiliary heat exchanger 8 and the width of the convexities 31 and 32 of the block joint 13 is 5 mm or less, which allows both members to be brazed favorably without causing air bubbles to occur in the brazed portion 34.

Additionally, in the present embodiment, a clearance of 0.5 mm or more is provided between the end plate 12 and block joint 13, other than at the brazed portion 34, and so moisture does not remain between the end plate 12 and the block joint 13.

Figure 11A:
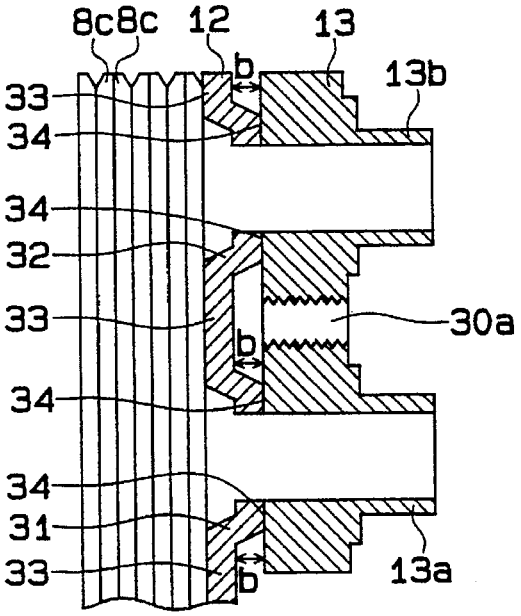
FIG. 11A is a sectional view corresponding to FIG. 9 of an evaporator according to a second embodiment of the present invention.
Figure 11B:
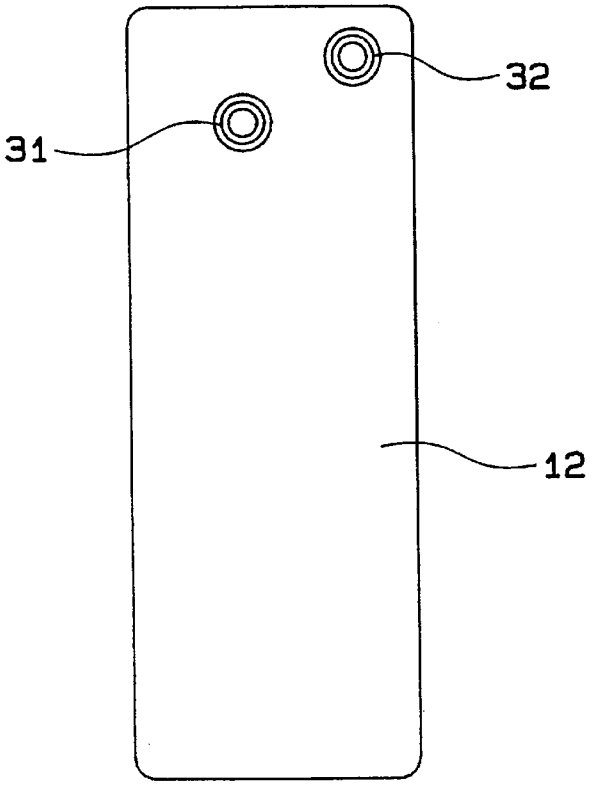
FIG. 11B is a side view of the evaporator of the second embodiment with a block joint not engaged.

A second embodiment of the present invention will be described next with reference to FIGS. 11A and 11B. FIG. 11A is a sectional view corresponding to FIG. 9, and FIG. 11B is a side view of the evaporator 6 wherein the block joint 13 is not engaged. Moreover, the structure, other than the end plate 12 and the block joint 13, is identical with the first embodiment.

According to the present embodiment, as shown in FIG. 11, convexities 31 and 32 and a concavity 33 are formed on an end plate 12 of the auxiliary heat exchanger 8. Additionally, the width of a brazed portion 34 of the end plate 12 and the block joint 13 is set to be 5 mm or less (preferably 3 mm). In addition, the clearance width (indicated by "b" in the drawing) between the end plate 12 and the block joint 13 is set to be 0.5 mm or more (preferably 1 mm). Furthermore, the end plate 12 is clad on both sides according to the present embodiment as well.

Effects similar to the first embodiment are demonstrated when the convexities 31 and 32 and concavity 33 are formed on the end plate 12 in this way.

Figure 12A:
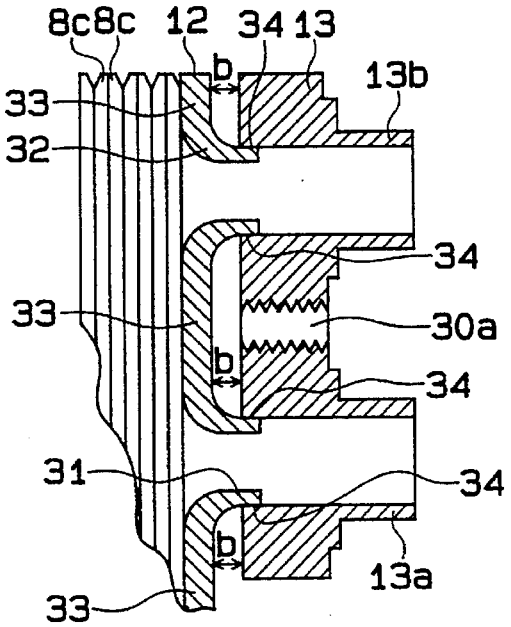
FIG. 12A is a sectional view corresponding to FIG. 9 of an evaporator according to a third embodiment of the present invention.
Figure 12B:
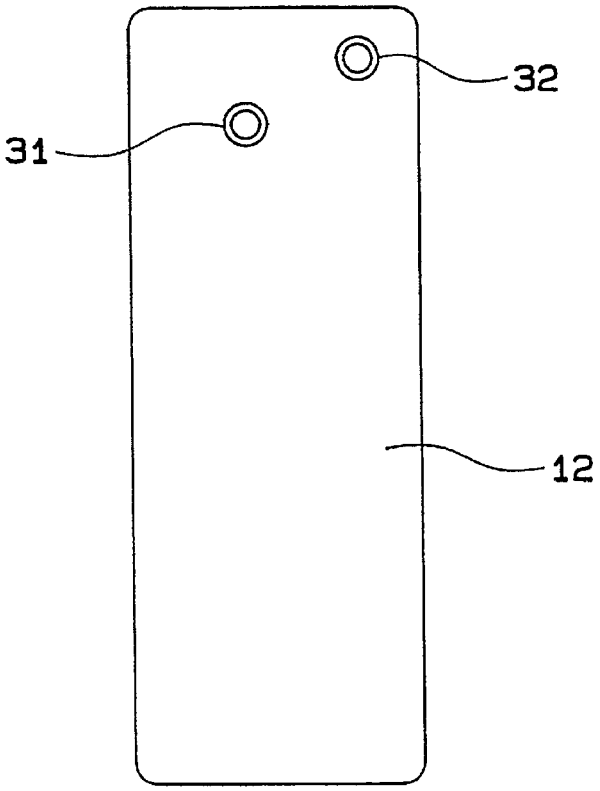
FIG. 12B is a side view of the evaporator of the third embodiment with a block joint not engaged.
Figure 13:
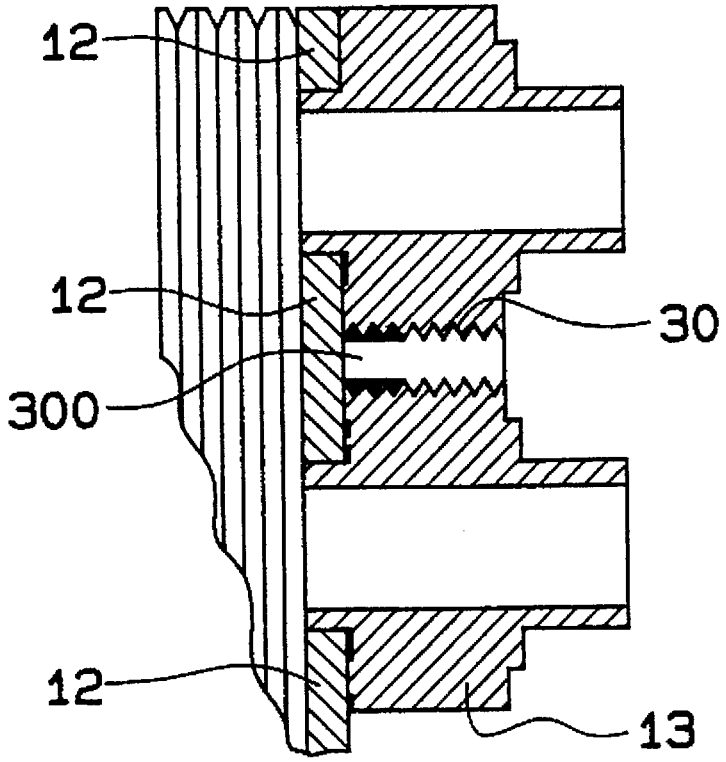
FIG. 13 is a sectional view corresponding to FIG. 9 of a related art evaporator.

A third embodiment of the present invention will be described next with reference to FIGS. 12A and 12B. FIG. 12A is a sectional view corresponding to FIG. 9, and FIG. 12B is a side view of the evaporator 6 wherein the block joint 13 is not engaged. Moreover, the structure, other than the end plate 12 and the block joint 13, is identical with the first embodiment.

According to the present embodiment, the end plate 12 is formed with a burring configuration in which punched-out portions 31 and 32 of cylindrical configuration are formed in the periphery of holes, and a convexity is formed by these punched-out portions 31 and 32. Additionally, an inlet tube 13*a* and outlet tube 13*b* of the block joint 13 are mated with the punched-out portions 31 and 32.

Furthermore, according to the present embodiment as well, the width of a brazed portion 34 of the pounced-out portions 31 and 32 and the block joint 13 is 5 mm or less (preferably 4 mm), and the clearance width (indicated by "b" in the drawing) between the end plate 12 and the block joint 13 is 0.5 mm or more (preferably 1 mm).

Effects similar to the first embodiment are demonstrated when the end plate 12 is structured so as to contact the inner sides of the inlet tube 13*a* and outlet tube 13*b* of the block joint 13 in this way.

What is claimed is:

1. A laminated-type evaporator for disposition in a refrigeration system on a downstream side of a pressure reducing means for reducing pressure of a refrigerant in the refrigeration system and on an intake side of a compressor for evaporating the pressure-reduced refrigerant, said laminated-type evaporator comprising:

a main heat exchanger having a refrigerant passage therein for performing heat exchange between refrigerant flowing within said refrigerant passage and cooled fluid flowing outside said refrigerant passage;

an auxiliary heat exchanger having an inlet-side refrigerant passage for introducing refrigerant from said pressure reducing means toward an inlet of said main heat exchanger refrigerant passage and an outlet-side refrigerant passage for introducing refrigerant from an outlet of said main heat exchanger toward said compressor, said auxiliary heat exchanger performing heat exchange between refrigerant flowing through said inlet-side refrigerant passage and refrigerant flowing through said outlet-side refrigerant passage; and a connecting member having a first communication hole for connecting with a downstream-side pipe of said pressure reducing means and a second communication hole for connecting with an intake-side pipe of said compressor, said connection member being fixed to said auxiliary heat exchange for communicating said first communication hole and said inlet-side refrigerant passage and communicating said second communication hole and said outlet-side refrigerant passage, wherein:

said refrigerant passage of said main heat exchanger is formed by an internal space formed by a pair of laminated thin metal plates, said main heat exchanger is provided with a plurality of said pair of thin metal plates, and fin means for enlarging a thermal-transmission surface area of heat exchange with said cooled fluid is provided between respective pairs of thin metal plates, said inlet-side refrigerant passage and said outlet-side refrigerant passage of said auxiliary heat exchanger are alternately formed on a front and rear side, respectively of said thin metal plates by lamination of a plurality of metal thin plates to form the inlet-side refrigerant passage and the outlet-side refrigerant passage between alternating pairs of the laminated plurality of thin metal plates, said connecting member has convexities which contact said auxiliary heat exchanger and which define contact portions in which said connecting member and said auxiliary heat exchanger are in mutual contact and non-contact portions in which a clearance is provided between said connecting member and said auxiliary heat exchanger, said clearance being of at least a predetermined dimension, and said contact portion has a width of not more than a second predetermined dimension.

2. A laminated-type evaporator according to claim 1, wherein:

said clearance provided between said auxiliary heat exchanger and said connecting member is at least 0.5 mm.

3. A lamented-type evaporator according to claim 1, wherein:

said contact portion between said auxiliary heat exchanger and said connecting member is not more than 5 mm.

4. A laminated-type evaporator according to claim 1, wherein:

said connecting member has a threaded hole opposing said clearance.

5. A laminated-type evaporator for disposition in a refrigeration system on a downstream side of a pressure reducing means for reducing pressure of a refrigerant in the refrigeration system and on an intake side of a compressor, for evaporating the pressure-reduced refrigerant, said laminated-type evaporator comprising:

a main heat exchanger having a refrigerant passage therein for performing heat exchange between refrigerant flowing within said refrigerant passage and cooled fluid flowing outside said refrigerant passage;

an auxiliary heat exchanger having an inlet-side refrigerant passage for introducing refrigerant from said pressure reducing means toward an inlet of said main heat exchanger refrigerant passage and an outlet-side refrigerant passage for introducing refrigerant from an outlet of said main heat exchanger toward said compressor, said auxiliary heat exchanger performing heat exchange between refrigerant flowing through said inlet-side refrigerant passage and refrigerant flowing through said outlet-side refrigerant passage; and a connecting member having a first communication hole for connecting with a downstream-side pipe of said pressure reducing means and a second communication hole for connecting with an intake-side pipe of said compressor, said connecting member being fixed to said auxiliary heat exchanger for communicating said first communication hole and said inlet-side refrigerant passage and communicating said second communication hole and said outlet-side refrigerant passage, wherein said refrigerant passage of said main heat exchanger is formed by an internal space formed by a pair of laminated thin metal plates, said main heat exchanger is provided with a plurality of said pair of thin metal plates, and fin means for enlarging a thermal-transmission surface area of heat exchange with said cooled fluid is provided between respective pairs of thin metal plates, said inlet-side refrigerant passage and said outlet-side refrigerant passage of said auxiliary heat exchanger are alternately formed on a front and rear side, respectively, of said thin metal plates by lamination of a plurality of metal thin plates, to form the inlet-side refrigerant passage and the outlet-side refrigerant passage between alternating pairs of the laminated plurality of thin metal plates, said auxiliary heat exchanger has convexities contacting said connecting member and which define contact portions in which said auxiliary heat exchanger and said connecting member are in mutual contact and non-contact portions in which a clearance is provided between said auxiliary heat exchanger and said connecting member, said clearance being of at least a predetermined dimension, and said contact portion has a width of not more than a second predetermined dimension.

6. A laminated-type evaporator according to claim 5, wherein:

said clearance formed between said auxiliary heat exchanger and said connecting member is 0.5 mm or more.

7. A laminated-type evaporator according to claim 5, wherein:

said contact portion between said auxiliary heat exchanger and said connecting member is not more than 5 mm.

8. A laminated-type evaporator according to claim 5, wherein:

said connecting member has a threaded hole opposing said clearance.

9. A laminated-type evaporator, fabricated by laminating thin metal plates together and for disposition in a refrigeration system on a downstream side of a pressure reducing means for reducing pressure of a refrigerant in the refrigeration system and on an intake side of a compressor, for evaporating the pressure-reduced refrigerant, said laminated-type evaporator comprising:

a main heat exchanger having a refrigerant passage in an internal space formed by a pair of laminated thin metal plates and fin means for enlarging a thermal-transmission surface area of said main heat exchanger provided between said respective pair of thin metal plates for performing heat exchange between refrigerant flowing within said refrigerant passage and cooled fluid flowing outside said refrigerant passage;

an auxiliary heat exchanger having an inlet-side refrigerant passage and an outlet-side refrigerant passage formed on a front and rear side, respectively, of said metal thin plate by laminating a plurality of said thin metal plates, said inlet-side refrigerant passage being for introducing refrigerant from said pressure reducing means toward an inlet of said main heat exchanger refrigerant passage and said outlet-side refrigerant passage being for introducing refrigerant from an outlet of said main heat exchanger toward said compressor, said auxiliary heat exchanger performing heat exchange between refrigerant flowing through said inlet-side refrigerant passage and refrigerant flowing through said outlet-side refrigerant passage; and a connecting member for connecting said auxiliary heat exchanger with a downstream-side pipe of said pressure reducing means and an intake-side pipe at said compressor, said connecting member having at least first and second convex portions, said first convex portion having a first communication hole for connecting with said downstream-side pipe of said pressure reducing means, said second convex portion having a second communication hole for connecting with said intake-side pipe of said compressor, said connecting member being fixed to said auxiliary heat exchanger to communicate said first communication hole and said inlet-side refrigerant passage and to communicate said second communication hole and said outlet-side refrigerant passage, said first and second convex portions and said auxiliary heat exchanger defining contact portions compressor, said connecting member having at least first and second convex portions, said first convex portion having a first communication hole four connecting with said downstream-side pipe of said pressure reducing means, said second convex portion having a second communication hole for connecting with said intake-side pipe of said compressor, said connecting member being fixed to said auxiliary heat exchanger to communicate said first communication hole and said inlet-side refrigerant passage and to communicate said second communication hole and said outlet-side refrigerant passage, said first and second convex portions and said auxiliary heat exchanger defining contact portions in which said connecting member and said auxiliary heat exchanger are in mutual contact and non-contact portions in which a clearance is provided between said connecting member and said auxiliary heat exchanger, said clearance being of at least a predetermined dimension, said contact portion having a predetermined surface area.

10. A laminated-type evaporator according to claim 9, wherein:

said thin metal plates are made of aluminum clad material and are brazed in a furnace after being assembled, the furnace having a temperature range between a melting point of brazing material and a melting point of a material of which said fin means is constructed.

11. A laminated-type evaporator according to claim 9, wherein:

said connecting member has a threaded hole disposed between said first and second convex portions and communicating with said clearance.

12. A laminated-type evaporator according to claim 9, wherein:

said clearance is open to atmospheric air so moisture does not stay in said clearance.

13. A laminated-type evaporator according to claim 11, wherein:

said connecting member is at least one block joint.

14. A laminated-type evaporator according to claim 13, further comprising a screw and wherein:

said connecting member includes two block joints and said screw fastens said two block joints to one another.

* * * * *